US005370314A

United States Patent [19]

Gebauer et al.

[11] Patent Number: 5,370,314

[45] Date of Patent: Dec. 6, 1994

[54] SPRAY GUN

[75] Inventors: Gerhard Gebauer, Bermatingen; Guido Zimmermann, Friedrichshafen, both of Germany

[73] Assignee: J. Wagner GmbH, Friedrichshafen, Germany

[21] Appl. No.: 117,794

[22] Filed: Sep. 8, 1993

[30] Foreign Application Priority Data

Sep. 28, 1992 [DE] Germany ..... 4232439

[51] Int. Cl.[5] ..... B05B 7/02

[52] U.S. Cl. ..... 239/526; 239/575; 239/590.3

[58] Field of Search ..... 239/525, 526, 575, 590, 239/590.3

[56] References Cited

U.S. PATENT DOCUMENTS

| | | | |
|---|---|---|---|
| 3,799,447 | 3/1974 | Beal | 239/520 X |
| 4,560,109 | 12/1985 | Teruyaki et al. | 239/526 X |
| 5,170,327 | 1/1993 | Petersen et al. | 239/520 |

FOREIGN PATENT DOCUMENTS

| | | | |
|---|---|---|---|
| 0263897 | 4/1988 | European Pat. Off. . | |
| 24436 | 3/1959 | German Dem. Rep. | 239/526 |
| 2055936 | 5/1972 | Germany . | |
| 3230247 | 2/1984 | Germany | 239/526 |
| 3236913 | 4/1984 | Germany . | |
| 4007880 | 8/1991 | Germany | 239/526 |
| 2067923 | 8/1981 | United Kingdom | 239/526 |

OTHER PUBLICATIONS

Wagner brochure entitled "Wagner Airless Hochdruck-Farbspritzpistolen".

Article from Metalloberflache 30 (1976) 6, pp. 288-291.

*Primary Examiner*—Andres Kashnikow

*Assistant Examiner*—Kevin P. Weldon

*Attorney, Agent, or Firm*—Hill, Steadman & Simpson

[57] ABSTRACT

In a spray gun for airless spraying of paints, the gun body and the handle are formed by thin-walled component parts composed of a chemically resistant, high-strength material, preferably stainless steel, and are each respectively entirely or partially surrounded with a closed covering composed of a chemically resistant material having low density. As a result of this design, a spray gun is created that exhibits low weight and, thus, can be used fatigue-free over a longer time span. Further, no chemical reactions occur when processing aggressive media; damage to the component parts is thus largely precluded. A portion of a hoop guard is detachable and functions as a tool for disengaging a portion of the handle housing a filter.

18 Claims, 4 Drawing Sheets

SPRAY GUN

BACKGROUND 0F THE INVENTION

The invention is directed to a spray gun for airless spraying of paints or similar media under high pressure, composed of a gun body provided with an atomizer nozzle and connectable to a delivery line, of a shut-off valve arranged in said gun body and to be opened with an actuation lever pivotably attached to the gun body, as well as of a handle provided at the gun body.

DE-A-20 55 936 discloses a spray gun of this type. The spray gun, as well as the handle secured thereto, are composed of aluminum in this design, this having proven itself extremely well in practice, in that these component parts are simple to process and are light in weight. Such guns are thus light in weight and enable fatigue-free use over a longer time span. Since, however, more and more media that have a detrimental influence on aluminum are being processed with such apparatus and, thus, the paint-carrying component parts can already be damaged after a short time, the service life of these spray guns is limited.

In order to counter premature damage and destruction, paint spray guns are commercially available having a gun body partly manufactured of stainless steel. Further, a connecting pipe that is also composed of stainless steel is secured thereto preceding the actuation lever. Although damage to the paint-carrying component parts caused by chemical reactions are thus precluded, these spray guns are extremely nose-heavy and, consequently, are ergonomically difficult for a user to manipulate. Since, moreover, some component parts of the gun body and of the handle are manufactured of aluminum, the risk of a chemical reaction when cleaning dirty spray guns in critical solvents is not precluded. Given this spray gun design, moreover, a filter for cleaning the medium to be sprayed can only be provided in the front region preceding the actuation lever. As a result, the spray gun becomes even more nose-heavy.

SUMMARY OF THE INVENTION

It is consequently an object of the invention to create a spray gun for airless spraying of paints or similar media of the type described above which not only is low in weight and, thus, can be used fatigue-free over a longer time span, but also wherein no chemical reactions occur even when processing aggressive media. It is important that damage to the component parts that come into contact with the medium to be sprayed should be largely precluded. It is also important that the spray gun have a balanced weight distribution so that it can be manipulated in a simple way. Further, it should be possible to manufacture the spray gun cost-beneficially, the spray gun should have a long service life, and the spray gun should be versatilely fashioned and used. Insofar as the delivery of the medium into the gun body ensues through the handle, moreover, a filter should be introducible thereinto and should be capable of being replaced easily and without difficulties, such as without requiring an additional tool for removal and replacement.

In a spray gun for airless spraying of paints or similar media of the above type, this is inventively achieved in that the gun body and the handle are formed by thin-walled high density component parts composed of a chemically resistant material having high strength, preferably a metal such as stainless steel, and are respectively entirely or partially surrounded by a closed cover composed of a chemically resistant material with low density.

It is thereby expedient to provide the gun body and/or the handle with clearances worked into the outside generated surface thereof for saving materials, whereby the clearances of the gun body and/or of the handle can be formed by constrictions, by notches, recesses, turned portions or the like extending in circumferential direction or in longitudinal direction thereof.

It is also expedient to manufacture the gun housing and/or the handle as a cast or forged member.

In a spray gun wherein the medium to be sprayed can be delivered to the gun body through the handle, the handle should be entirely or partially formed by a lengthening piece projecting from the gun housing.

Given a handle partially formed by the applied lengthening piece of the gun housing, a thin-walled adaptor of a chemically resistant, high-strength material, preferably stainless steel, should be screwed thereinto, this being provided with a covering roughly corresponding to the outside generated surface of the lengthening piece. The lengthening piece and/or the adaptor should also be equipped with a receptacle chamber for a filter cartridge and the free end of the adaptor should comprise key surfaces, a collar or similar structure for transmitting torque and should also comprise a thread for the acceptance of a connecting nipple.

In a further embodiment the actuation lever that is pivotably articulated to the gun housing should be enclosed in adjustment direction by a hoop guard supported at the gun housing and at the handle. This hoop guard can be composed of a front-end element attached to the gun housing and a retainer element detachably connected thereto at the free end thereof.

It is thereby appropriate to hold the front-end member at the gun housing at one end with a limited pivot and to attach a leg to the other end which projects in the direction of the retainer element, this leg being engageable with the retainer element.

The detachable connection of the front-end member to the retainer element can be provided, for example, with a pocket formed by laterally positioned webs into which the leg of the front-end member can be introduced. The leg of the front-end member can comprise a bracket or clip that extends approximately parallel to the leg which is preferably equipped with a catch nose that engages into a recess of the retainer element and between which the retainer element can be clamped.

In order to enhance its strength, the front-end element can have a cross sectional area fashioned with convex-concave curvature in the region of the actuation lever. Further, the retainer element should be attached to the handle by means of a key opening that is matched to the key surfaces formed on the adaptor.

In a simple embodiment, the cover of the gun body can be fashioned as a hollow box-like shaped member that is open at the front side facing toward the atomizer nozzle and that is firmly joined to the gun body. This member has its back side provided with a clearance or with a preferably closed chamber for the acceptance of the actuation elements of the shut-off valve. Further, the cover can be provided with a suspension hook or an eyelet at the side lying opposite the actuation lever.

In a different embodiment, however, the gun body can also be provided with a thin-walled, suspension hook or an eyelet that is matches the contour of the suspension hook or eyelet provided by the covering of the gun body. The thin-walled suspension hook is preferably fashioned U-shaped in cross section and is surrounded by the gun body covering.

The covering of the handle, by contrast, can be formed by a tubular cladding made of a plastic material that is sprayed onto the adaptor and is preferably provided with a rifling, with longitudinal grooves or the like.

When a spray gun for airless spraying of paints or similar media is fashioned in conformity with the invention, then one can not only spray aggressive media with this without fearing that damage to the gun body and/or the handle will occur due to chemical reactions, but the spray gun also enables fatigue-free work over a longer time span as a consequence of its low dead weight and its ergonomic balance. When, namely, the gun body and/or the handle is/are formed by thin-walled component parts composed of a chemically resistant, high-strength material, preferably stainless steel, which is clad by coverings composed of a chemically resistant, low-density material for visual aesthetic reasons and to provide proper sized gripping surfaces, then it is nearly impossible that these component parts can be attacked by the medium conducted through them. An increase in the dead weight of the spray gun is avoided and instead a balanced weight distribution is provided.

Further, the gun body and/or the handle can be cost-beneficially manufactured as cast or forged members. The spray gun can also be fashioned in different ways, for example with delivery of the medium to be sprayed through the handle or directly into tile gun body. Further, a guard hoop provided in front of the actuation lever can be fashioned as a tool in order, given a spray gun having a filter cartridge traversed by tile medium arranged in the handle, to be able to replace this in a short time and without a separate tool being required for the purpose. The spray gun fashioned in accord with this invention, consequently, can be advantageously utilized in an extremely versatile way and enables a malfunction-free operation over a long time span.

BRIEF DESCRIPTION OF THE DRAWINGS

The drawings show an exemplary embodiment of the spray gun for airless spraying of paints or similar media fashioned in conformity with the invention, this being set forth in detail below.

DETAILED DESCRIPTION OF THE PREFERRED EMBODIMENTS

Figure 1:
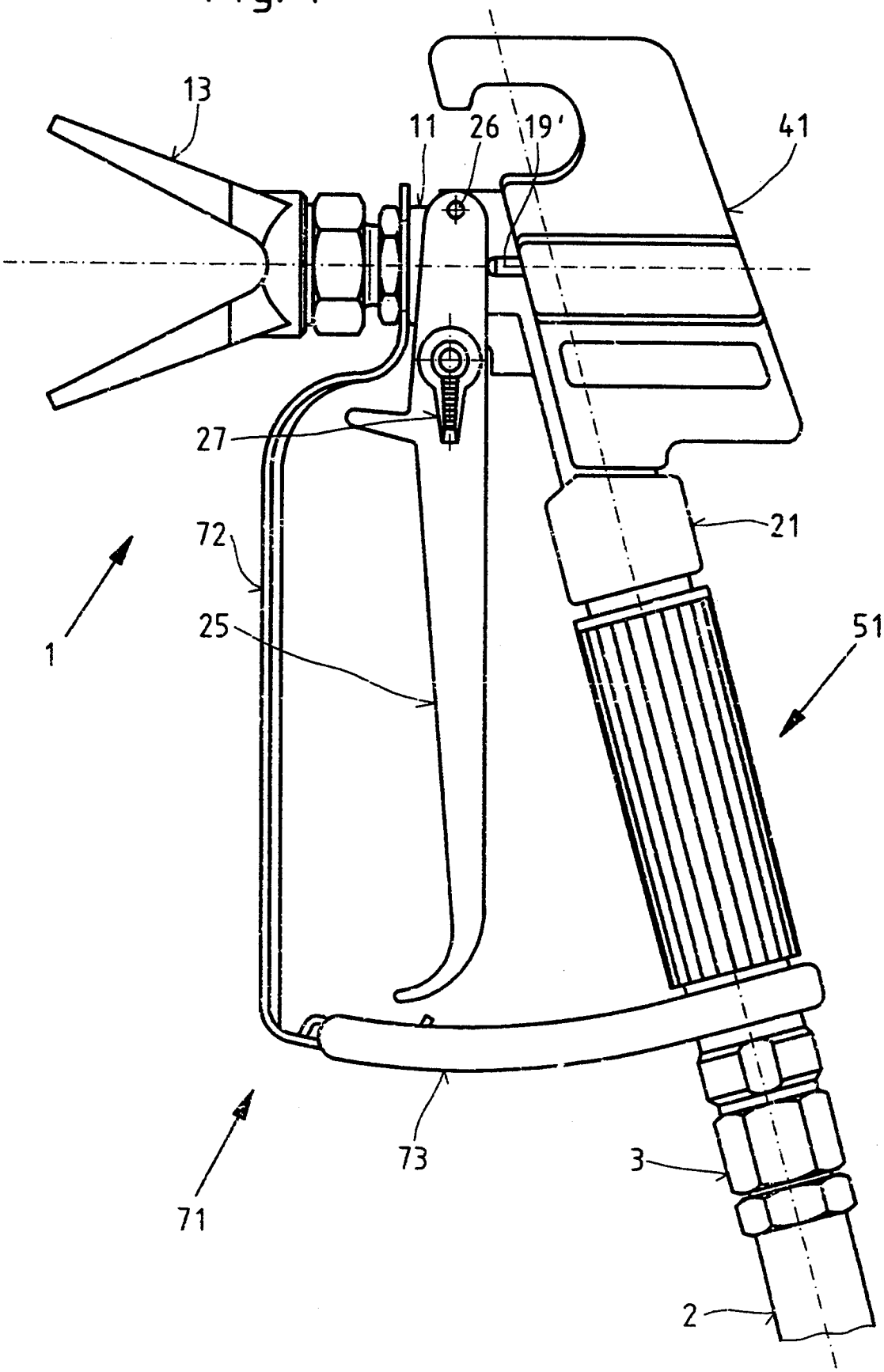
FIG. 1 illustrates a spray gun embodying the principles of the present invention in a side view.
Figure 2:
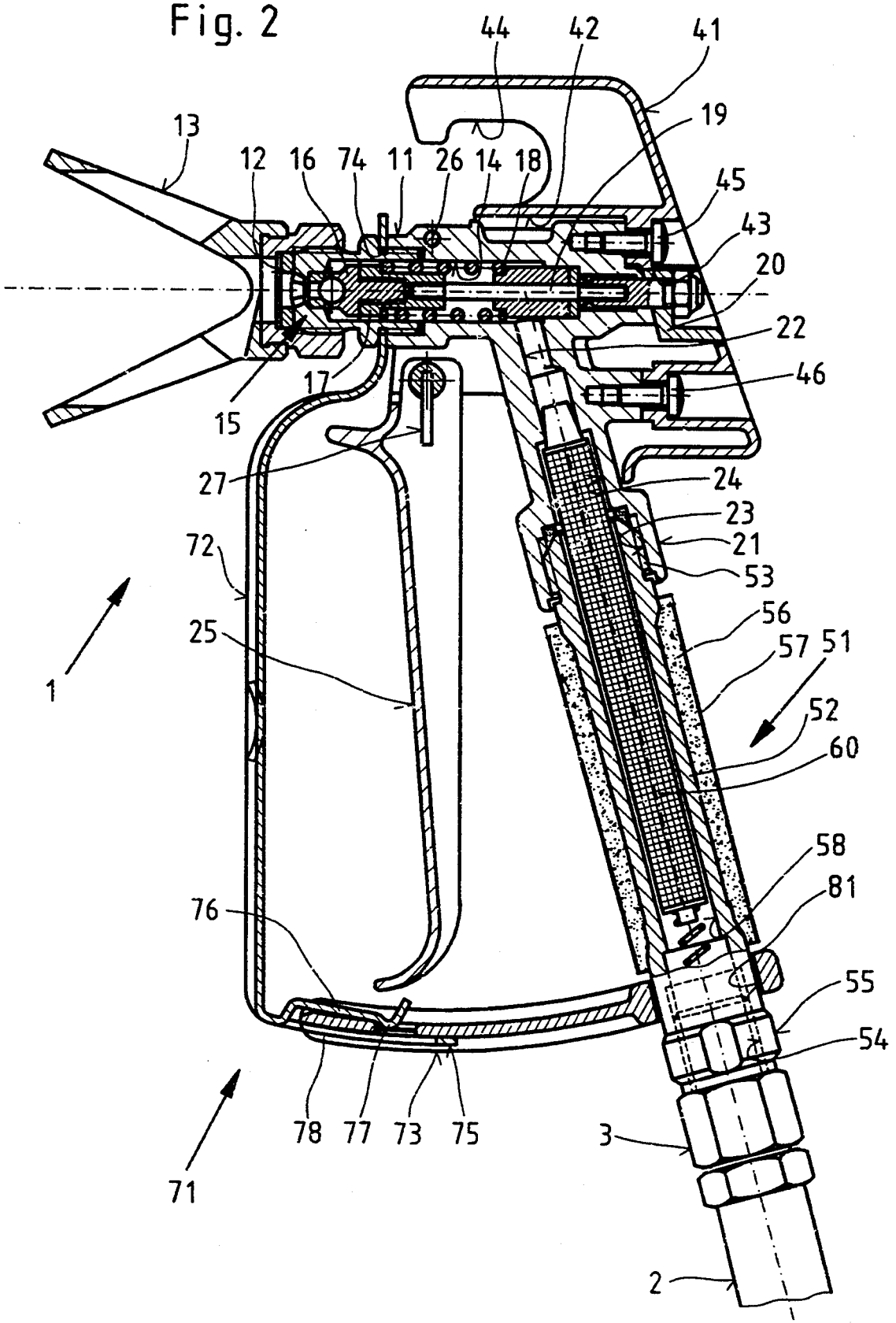
FIG. 2 illustrates the spray gun of FIG. 1 in an axial section.

A spray gun 1 is shown in FIGS. 1 and 2 and serves the purpose of airless spraying of paints or similar media at pressures above 100 bar. The spray gun 1 is essentially composed of a gun body 11 that is provided with an atomizer nozzle 12, of a shut-off valve 15 arranged thereat and introduced into the gun body 11 that can be opened with an actuation lever 25, and of a handle 51 supported at the gun body 11. The actuation lever 25 is protected against unintentional adjustment motions by a guard hoop 71. Moreover, the actuation lever 25 can be locked by a locking lever 27.

In the illustrated exemplary embodiment, the medium to be sprayed is supplied to the gun body 11 via the handle 51 which is connected by a nipple 3 to a delivery line 2 for this purpose and is screwed into a lengthening piece 21 of the gun body 11 that forms a part of the handle and is provided with a threaded bore 23. The medium to be sprayed proceeds via a bore 22 provided in the lengthening piece 21 into a chamber 14 of the gun body 11 in which a valve gate or valve body 16 that is adjustable toward the right opposite the force of a spring 18 is arranged. The valve gate or body 16 is thereby screwed in a sleeve 17 on which the spring 18 acts.

Further, the sleeve 17 is connected to a connecting piece 20 via a rod 19. Two rods 19' are provided at both sides outside the gun body 11 and guided therein, these two rods 19' proceeding parallel to the axis of the rod 19 and being coupled to the sleeve 17 via the connecting piece 20. The actuation lever 25 is pivotally mounted on a pin 26 which is introduced into a bore 35 of the gun body 11. The actuation lever 25 acts on the rods 19' given an adjustment of the actuation lever 25 toward the handle 51, so that the shut-off valve 15 is opened and the pressurized medium residing in the chamber 14 can flow out of the atomizer nozzle 12. In order to avoid injuries by the spray jet, a protective nozzle basket 13 is attached to the atomizer nozzle 12.

Figure 4:
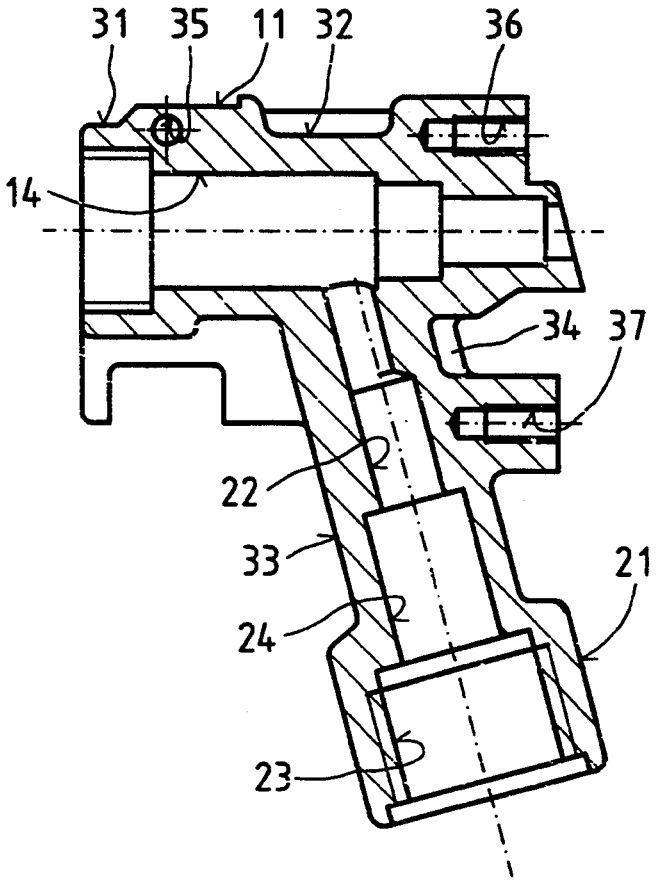
FIG. 4 illustrates the gun body of the spray gun of FIGS. 2 and 3 in an enlarged view.

As may particularly be derived from FIG. 4, the gun body 11 is manufactured of a thin-walled forged or cast member of a chemically resistant material having high strength, preferably a metal such as stainless steel, and is provided with various clearances in the form of constrictions 31, notchings 32 and recesses 33 and 34 in order to save materials and reduce weight. The gun body 11 is thus extremely resistant even when processing aggressive media but its dead weight is nonetheless extremely low.

In order to clad the constriction 31, the notching 32 and the recesses 33 and 34, a covering 41 is arranged on the gun body 11, this covering being fashioned as a box-like hollow member 42 and being manufactured of low-density material that is chemically resistant, for example polyamide, polypropelene, polyethylene or PTFE. The covering 41 is secured to the gun body 11 with screws 45 and 46 that engage into threaded bores 36 and 37 that are worked into the gun body 11. Further, a clearance 43 for the acceptance of the connecting piece 20 of the two rods 19 is worked into the back wall of the hollow member 42 and a suspension hook 44 is attached to the upper side.

The part of the handle 51 screwed into the lengthening piece 21 of the gun body 11 is likewise composed of a thin-walled component part of chemically resistant, high-strength material, preferably stainless steel, namely of an adaptor 52 that is provided with an outside thread 53 at one end for connection to the lengthening piece 21 and is provided with an inside thread 54 at the other end for connection of the nipple 3. Further, the adaptor 52 comprises a receptacle chamber 58 that aligns with a receptacle chamber 24 that is worked into the lengthening piece 21. A filter cartridge 60 is introduced into the receptacle chambers 24 and 58 and can be replaced as needed. Further, a covering 56 in the form of a cladding composed of a chemically resistant material having low density is sprayed onto the thin-walled adaptor 52, longitudinal grooves 57 being formed in this covering 56 in order to enhance graspability.

Figure 5:
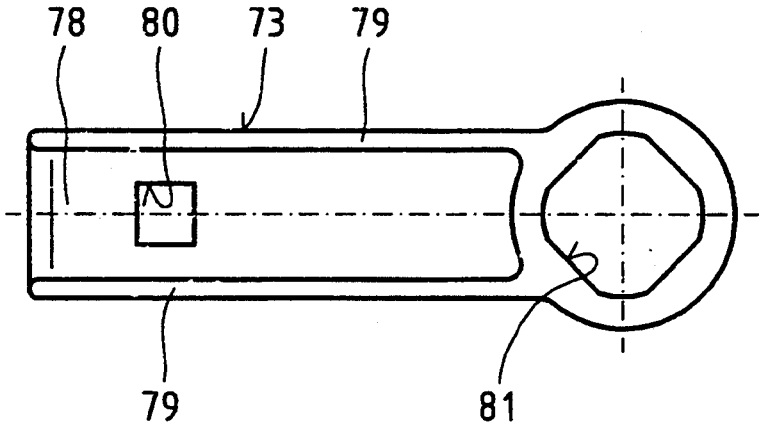
FIG. 5 illustrates the retainer element of the two-part guard hoop supported at the handle of the spray gun of FIGS. 2 and 3 in a plan view.

The guard hoop 71 in the illustrated exemplary embodiment is composed of a front-end member 72 and a retainer element 73. The front-end member 72 has one end seated at the gun body 11 with limited pivotability by means of a bore 74 formed therein. A leg 75 to which the retainer element 73 is detachably secured is provided at the other end. To that end, a bracket or clip 76 that proceeds approximately parallel to the leg is bent out from the leg 75 and comprises a catch nose 77. As may be derived from FIG. 5, an opening 80 into which the catch nose 77 engages is formed in the retaining element 73. The front-end member 72 can thus be easily detached from the retainer element 73. So that the leg 75 of the front-end member 72 is guided, webs 79 are laterally formed on the retainer element 73, resulting in the formation of a receptacle pocket 78 for the leg 75.

When the front-end member 72 is detached from the retainer element 73, the retainer element 73 can be employed as a tool in order to unscrew the adaptor 52 from the lengthening piece 21 in a simple way. This thus, enables removal of the filter cartridge 60 from the receptacle chambers 24 and 58. In order to accomplish this, key surfaces 55 are provided on the adaptor 52 and the retainer element 73 has a complementary key opening 81 provided therein. Thus, when the retainer element 73 is detached from the front-end member 72, the retainer element can be displaced in the direction of the nipple 3 and can be put in place onto the key surfaces 55 of the adaptor 52. The adaptor 52 can be turned in this operating position with the assistance of the retainer element 73 and can thus be screwed out of the lengthening piece 21 of the gun body 11.

Figure 3:
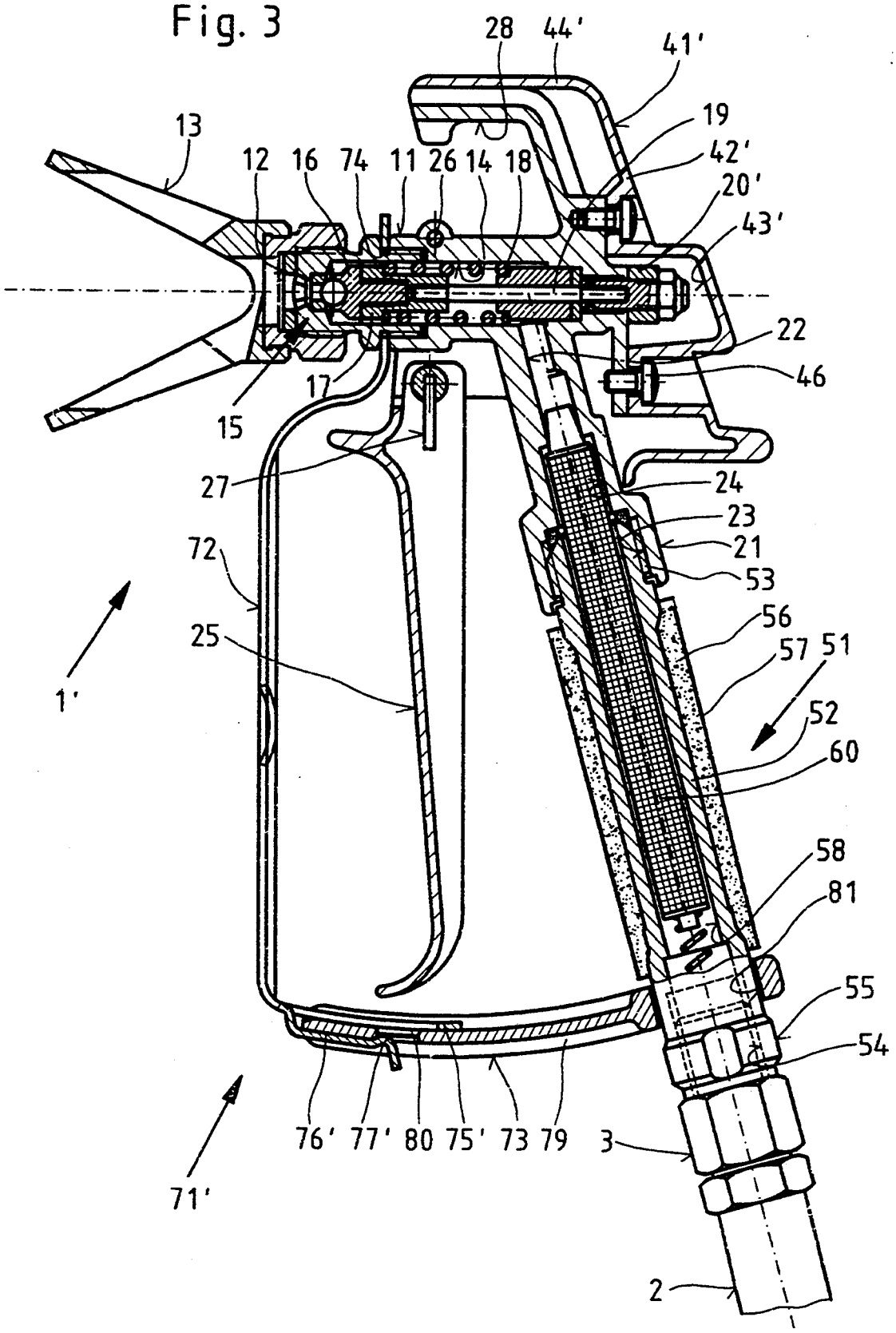
FIG. 3 illustrates a modified embodiment of the spray gun of FIG. 1, likewise in an axial section.

In an alternate embodiment of a spray gun 1' shown in FIG. 3, the covering 41' is likewise fashioned as a hollow member 42' into which, however, a chamber 43' is formed, this accepting the actuation elements of the shut-off valve 15. The back side of the covering 41' is thus closed.

In this version of the embodiment, further, a thin-walled suspension hook 28 extends from to the gun body 11, this being matched to the contour of a suspension hook 44' provided at the covering 41' The covering 41' is thereby fashioned U-shaped in cross-section, so that the suspension hook 28 of the gun body 11 is surrounded by the covering 41 at the three outer sides. The connecting piece that couples the rods 19 to the two outer rods 19' is referenced 20' in FIG. 3.

Further, the clip or bracket 76' attached to the front-end member 72 of the guard hoop 71' and having the catch nose 77', engages from the outside into the recess 80 of the retainer element 73, so that the retainer element is held between the leg 75' and the clip or bracket 76' of the front-end member 72 and unintentional detachment is avoided in this way.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A spray gun for airless spraying of paints or similar media under high pressure, composed of a gun body comprising:

an atomizer nozzle connectable to a delivery line;

a shut-off valve arranged in said nozzle openable with an actuation lever pivotably attached to said gun body;

a handle secured to said gun body;

said gun body being formed by thin-walled component parts of a chemically resistant, metallic material and said handle being formed by thin-walled component parts of a chemically resistant, metallic material and being at least partially surrounded with a closed covering of a low density chemically resistant material;

at least one of said gun body and said handle being composed of one of a cast and forged member; and at least one of said gun body and said handle being provided with clearances formed in an outside generated surface thereof for reducing weight and material.

2. A spray gun according to claim 1, wherein said clearances of at least one of said gun body and said handle are formed by constrictions extending in at least one of circumferential and longitudinal direction thereof.

3. A spray gun according to claim 1, wherein said medium to be sprayed is delivered to said gun body through said handle and said handle is at least partially formed by a lengthening piece that projects from said gun body.

4. A spray gun according to claim 3, wherein a thin-walled adaptor composed of a chemically resistant material having high strength is screwed into said lengthening piece to form a further portion of said handle, said adaptor being provided with a covering that approximately corresponds to an outer generated surface of said lengthening piece.

5. A spray gun according to claim 3, wherein said lengthening piece is provided with a receptacle chamber for a filter cartridge.

6. A spray gun according to claim 4, wherein said adaptor has a free end provided with key surfaces for transmission of a torque.

7. A spray gun according to claim 4, wherein said adaptor has a free end provided with a thread for the acceptance of a connecting nipple.

8. A spray gun according to claim 1, wherein said actuation lever pivotably hinged to said gun body is enclosed in adjustment direction by a hoop guard that is supported at said gun body and at said handle.

9. A spray gun for airless spraying of paints or similar media under high pressure, composed of a gun body comprising:

an atomizer nozzle connectable to a delivery line;

a shut-off valve arranged in said nozzle openable with an actuation lever pivotably attached to said gun body;

a handle secured to said gun body;

said gun body and said handle being formed by thin-walled component parts of a chemically resistant, high density and high-strength material and are at least partially surrounded with a closed covering of a low density chemically resistant material;

said actuation lever being enclosed in adjustment direction by a hoop guard that is supported at said gun body and at said handle;

wherein said hoop guard is composed of a front-end member attached to said gun body and a retainer element detachably connected to said front-end member at a free end of said retainer element.

10. A spray gun according to claim 9, wherein said front-end member has one end held with limited pivotability at said gun body and has an opposite end comprising a leg projecting in a direction facing said retainer element which can be latched to said retainer element.

11. A spray gun according to claim 10, wherein for the detachable connection of said front-end member to said retainer element, a pocket is formed by laterally disposed webs into which said leg of said front-end member can be introduced, and wherein said leg of said front-end member comprises a clip proceeding approximately parallel to said leg, said clip being provided with a catch nose engaging into a recess of said retainer element, said retainer element being capable of being clamped between said leg and said clip.

12. A spray gun according to claim 9, wherein said front-end member comprises a cross-sectional surface fashioned with convex-concave curvature in a region of said actuation lever.

13. A spray gun according to claim 1, wherein said covering of said gun body is fashioned as a hollow member designed box-like which is open at a front side facing toward said atomizer nozzle, said hollow member being firmly connected to said gun body and having its back side provided with one of a clearance and a closed chamber for the acceptance of actuation elements of said shut-off valve.

14. A spray gun according to claim 13, wherein said covering of said gun body has its side lying opposite said actuation lever provided with a suspension hook.

15. A spray gun according to claim 1, wherein said gun body includes a thin-walled, applied suspension hook.

16. A spray gun according to claim 4, wherein said covering of said handle is formed by a tubular cladding composed of a plastic material that is sprayed on the adaptor and is provided with external longitudinal depressions.

17. A spray gun for airless spraying of paints or similar media under high pressure, composed of a gun body comprising:

an atomizer nozzle connectable to a delivery line;

a shut-off valve arranged in said nozzle openable with an actuation lever pivotably attached to said gun body;

a handle formed by a lengthening piece that projects from said gun body;

an adapter screwed into said lengthening piece to form a further portion of said handle;

said adaptor provided with key surfaces for transmission of a torque;

said delivery line connectable to said atomizer nozzle through said adapter wherein said medium to be sprayed is delivered to said gun body through said handle;

said actuation lever being enclosed in adjustment direction by a hoop guard that is supported at said gun body and at said handle;

said hoop guard being composed of a front-end member attached to said gun body and a retainer element detachably connected to said front-end member at a free end of said retainer element;

said retainer element being supported at said handle by means of a key opening which is shaped complementarily to said key surfaces;

whereby said retainer element is engageable with said adapter key surfaces to assist in the rotation of said adapter relative to said lengthening piece.

18. A spray gun according to claim 17, wherein said retainer element is supported at said handle at a position spaced away from said key surfaces, and said retainer element is movable, after being detached from said front-end member, to engage said key surfaces.

* * * * *